US011118479B2

(12) United States Patent
Barb et al.

(10) Patent No.: US 11,118,479 B2
(45) Date of Patent: Sep. 14, 2021

(54) STRESS MITIGATING ARRANGEMENT FOR WORKING FLUID DAM IN TURBINE SYSTEM

(71) Applicant: General Electric Company, Schenectady, NY (US)

(72) Inventors: Kevin Joseph Barb, Halfmoon, NY (US); Steven Andrew Wesley, Glenville, NY (US); David Arthur Brigham, Ballston Lake, NY (US); Michael Andrew Nyman, Clifton Park, NY (US); Edward Leo Kudlacik, Glenville, NY (US); Christoph Gerald Krenn, Vienna (AT)

(73) Assignee: General Electric Company, Schenectady, NY (US)

( * ) Notice: Subject to any disclaimer, the term of this patent is extended or adjusted under 35 U.S.C. 154(b) by 102 days.

(21) Appl. No.: 16/710,292

(22) Filed: Dec. 11, 2019

(65) Prior Publication Data

US 2021/0180468 A1 Jun. 17, 2021

(51) Int. Cl.

| | |
|---|---|
| ***F01D 25/26*** | (2006.01) |
| ***F01D 25/24*** | (2006.01) |
| *F01D 3/02* | (2006.01) |
| *F01K 23/10* | (2006.01) |

(52) U.S. Cl.

CPC ..... *F01D 25/26* (2013.01); *F01D 25/246* (2013.01); *F01D 3/02* (2013.01); *F01K 23/106* (2013.01); *F05D 2220/31* (2013.01); *F05D 2260/2322* (2013.01)

(58) Field of Classification Search

CPC ..... F01D 25/26; F01D 25/246; F01D 3/02; F01K 23/106; F05D 2220/31; F05D 2260/2322

See application file for complete search history.

(56) References Cited

U.S. PATENT DOCUMENTS

| | | | | |
|---|---|---|---|---|
| 3,817,654 A * | 6/1974 | Sohma | F01D 5/06 | 415/103 |
| 4,764,084 A * | 8/1988 | Parker | F01D 9/048 | 415/101 |
| 4,826,395 A * | 5/1989 | Groenendaal, Jr. | F01D 9/02 | 415/101 |
| 8,317,458 B2 * | 11/2012 | Rivas | F01D 25/12 | 415/1 |
| 8,506,245 B2 * | 8/2013 | Xiong | F01D 25/243 | 415/214.1 |
| 8,657,562 B2 * | 2/2014 | Burdgick | F01D 9/02 | 415/101 |

* cited by examiner

*Primary Examiner* — Jesse S Bogue
(74) *Attorney, Agent, or Firm* — James Penrick; Hoffman Warnick LLC

(57) ABSTRACT

A casing half shell for a turbine system, a steam turbine system and related method are provided. The casing half shell includes a body having an open interior for enclosing parts of the turbine system; a first inlet in the body for delivering a first working fluid flow into the open interior in a first direction; and a second inlet in the body for delivering a second working fluid flow into the open interior in a second direction that is opposed to the first direction. A working fluid dam extends radially and axially in the body between the first inlet and the second inlet, the working fluid dam includes a stress-mitigating slot extending radially therein. A fill member may be mounted in the stress-mitigating slot to provide full functioning of the working fluid dam.

20 Claims, 13 Drawing Sheets

STRESS MITIGATING ARRANGEMENT FOR WORKING FLUID DAM IN TURBINE SYSTEM

BACKGROUND

The disclosure relates generally to turbine systems, and more particularly, to a stress mitigating arrangement for a working fluid dam in a turbine system.

Turbine systems are used widely to generate power. One common form of turbine system is a steam turbine system. Many steam turbine (ST) systems include a number of sequential turbines that handle different pressure steam, e.g., a high pressure (HP) turbine, an intermediate pressure (IP) turbine and a low pressure (LP) turbine. In one approach the HP-IP steam turbines are arranged in a casing with an opposed flow configuration because it is most cost efficient compared to a system including separate HP and IP steam turbine casings. The HP steam turbine and the IP steam turbine can be provided together in a casing that includes two, coupled casing half-shells. Steam may be delivered to such a system using 'close coupled' or casing mounted valves, which are more cost-efficient because they eliminate expensive connecting piping. In this setting, valves are directly mounted to the outer casing such that steam is directed tangentially into the casing from opposed sides of the casing. A steam dam is provided between the inlets in the casing in the HP or IP steam turbine to direct the steam axially into the HP or IP steam turbine and prevent flow oscillations. Typically, the steam dam is cast into the casing. One challenge with this approach is that the added material can create a high local stress that requires additional maintenance, and thus can reduce the availability of the steam turbines.

BRIEF DESCRIPTION

A first aspect of the disclosure provides a casing half shell for a turbine system, the casing half shell comprising: a body having an open interior for enclosing parts of the turbine system; a first working fluid flow path in the body for directing a first working fluid flow in the open interior in a first direction; a second working fluid flow path in the body for directing a second working fluid flow in the open interior in a second direction that is opposed to the first direction; and a working fluid dam extending radially and axially in the body between the first working fluid flow path and the second working fluid flow path, the working fluid dam including a stress-mitigating slot extending radially therein.

A second aspect of the disclosure provides a steam turbine (ST) system, the ST system comprising: at least one of a high pressure (HP) turbine and an intermediate pressure (IP) turbine; a casing including a body having an open interior for enclosing the at least one of the HP steam turbine and the IP steam turbine; a first working fluid flow path in the body for directing a first working fluid flow in the open interior in a first direction; a second working fluid flow path in the body for directing a second working fluid flow in the open interior in a second direction that is opposed to the first direction; and a steam dam extending radially and axially in the body between the first working fluid flow path and the second working fluid flow path to redirect the first and second working fluid flows to the at least one of the HP steam turbine and the IP steam turbine, the steam dam including a stress-mitigating slot extending radially therein; and a fill member mounted in the stress-mitigating slot.

A third aspect of the disclosure provides a method, comprising: providing a casing half shell for a turbine system, the casing half shell including a body having open interior, a first working fluid flow path in the body for directing a first working fluid flow in the open interior in a first direction, a second working fluid flow path in the body for directing a second working fluid flow in the open interior in a second direction that is opposed to the first direction, and a working fluid dam extending radially and axially in the body between the first working fluid flow path and the second working fluid flow path; forming a stress-mitigating slot extending radially in the working fluid dam; and fixedly coupling a fill member in the stress-mitigating slot.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
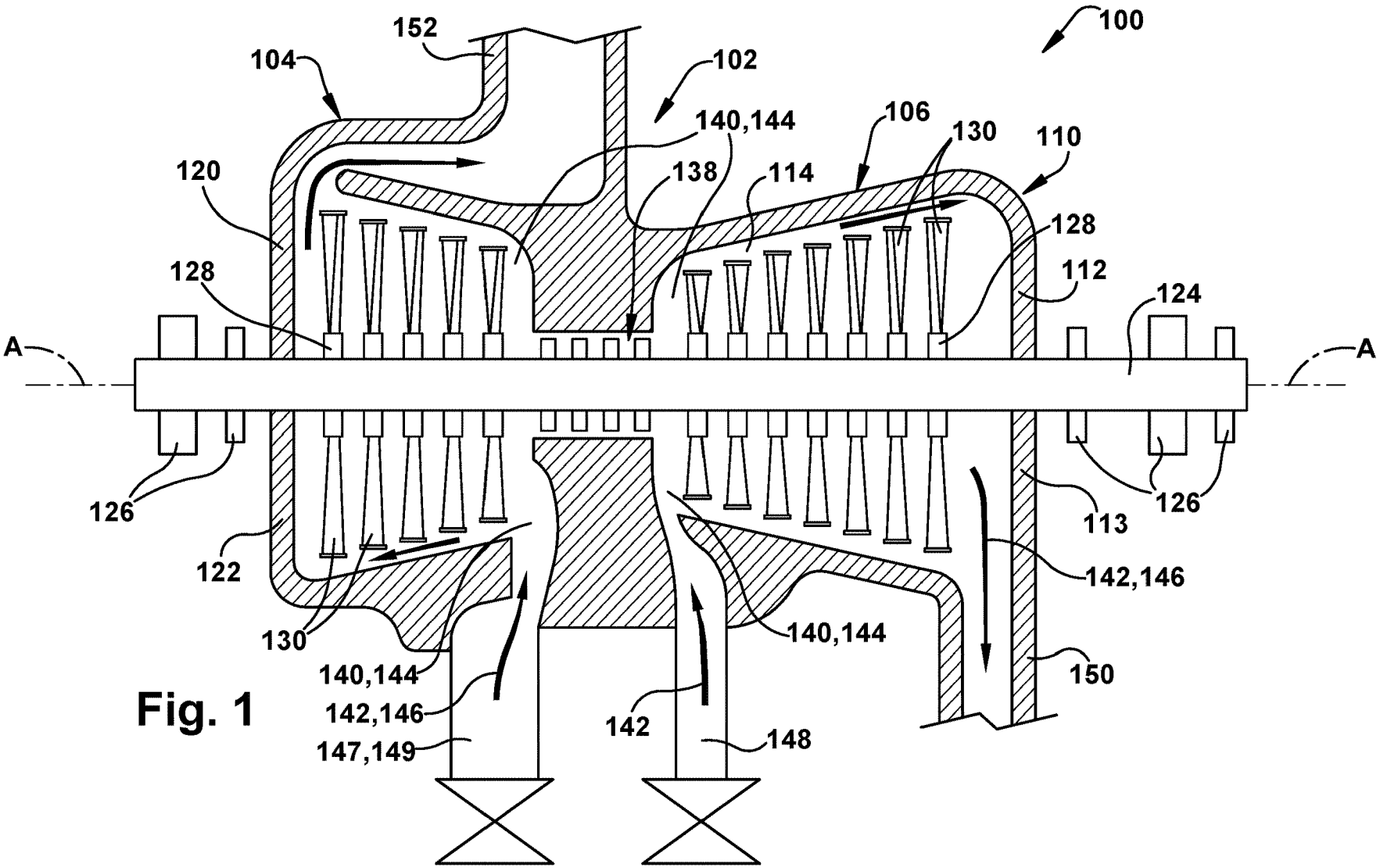
FIG. 1 shows a schematic cross-sectional view of an illustrative turbine system in the form of a high pressure-intermediate pressure (HP-IP) steam turbine (ST) system.

It is noted that the drawings of the disclosure are not necessarily to scale. The drawings are intended to depict only typical aspects of the disclosure, and therefore should not be considered as limiting the scope of the disclosure. In the drawings, like numbering represents like elements between the drawings.

DETAILED DESCRIPTION

As an initial matter, in order to clearly describe the current disclosure it will become necessary to select certain terminology when referring to and describing relevant machine components within a turbine system. When doing this, if possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through the turbine system or, for example, the flow of air through the combustor or coolant through one of the turbine's component systems. The term "downstream" corresponds to the direction of flow of the fluid, and the term "upstream" refers to the direction opposite to the flow. It is recognized that in an opposed flow configuration, upstream and downstream directions may change depending on where one is in the turbine system. The terms "forward" and "aft," without any further specificity, refer to directions, with "forward" referring to the front end of the turbine system, and "aft" referring to the rearward of the turbine system. It is often required to describe parts that are at differing radial positions with regard to a center axis. The term "radial" refers to movement or position perpendicular to an axis. In cases such as this, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. The term "axial" refers to movement or position parallel to an axis. Finally, the term "circumferential" refers to movement or position around an axis. It will be appreciated that such terms may be applied in relation to the center axis of the turbine system, e.g., an axis of a rotor thereof.

In addition, several descriptive terms may be used regularly herein, as described below. The terms "first", "second", and "third" may be used interchangeably to distinguish one component from another and are not intended to signify location or importance of the individual components.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. "Optional" or "optionally" means that the subsequently described event or circumstance may or may not occur, and that the description includes instances where the event occurs and instances where it does not.

Where an element or layer is referred to as being "on," "engaged to," "disengaged from," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

As indicated above, the disclosure provides a casing half shell for a turbine system such as a steam turbine (ST) system, and a related method. The ST system may include, for example, at least one of a high pressure (HP) steam turbine and an intermediate pressure (IP) steam turbine. For purposes of description only, the ST system is illustrated as a high pressure-intermediate pressure (HP-IP) steam turbine (ST) system. The casing half shell can be used in, for example, an HP ST system, an IP ST system, and/or an HP-IP ST system. In any event, the casing half shell includes a body having an open interior for enclosing parts of the turbine system. Where the casing half shell is, for example, a lower half shell casing, it may also include a first inlet in the body for delivering a first working fluid flow into the open interior in a first direction; and a second inlet in the body for delivering a second working fluid flow into the open interior in a second direction that is opposed to the first direction. Alternatively, when the casing half shell is an upper casing half shell, it may be devoid of the inlets. In any event, a working fluid dam extends radially and axially in the body at a location where tangentially opposing working fluid flow paths meet. In a lower casing half shell, the location may be between the first inlet and the second inlet. In contrast to conventional working fluid dams, the working fluid dam includes a stress-mitigating slot extending radially therein. The slot reduces stress in a high stress-prone area that may form in the dam and forces stresses radially outward in the casing half shell to either maintain current stress or relieve the high stress from the working fluid dam. A fill member may be mounted in the stress-mitigating slot to otherwise provide full functioning of the working fluid dam.

FIG. 1 shows a cross-sectional schematic view of an illustrative turbine system 100 in the form of a high pressure and intermediate pressure (HP-IP) steam turbine (ST) system 102. While the disclosure will be described as applied to HP-IP ST system 102, the teachings of the disclosure may be applicable to other forms of ST systems such as an HP steam turbine system or an IP steam turbine system. The teachings of the disclosure are also applicable to turbine systems 100 in which a working fluid other than steam reacts in the casing in opposing tangential directions, e.g., gas turbines, jet engines, low pressure steam turbines, compressors, etc. The example shows a double casing half-shell, opposed flow configuration. In this setting, HP-IP ST system 102 may include a high pressure (HP) steam turbine 106 and an intermediate pressure (IP) steam turbine 104. HP-IP system 102 also includes a casing 110 having an open interior 114 for enclosing HP steam turbine 106 and IP steam turbine 104. More particularly, casing 110 may include a pair of casing half shells 120, 122 that are coupled together to collectively form open interior 114. A lower casing half shell 122 may include body 112, and upper casing half shell 120 may include body 113. Here, body 112, 113 may have a generally semi-circular shape. Casing half shells 120, 122 are fastened together using any now known or later developed system, e.g., bolts. A seam between casing half shells 120, 122 is hidden behind rotor 124 in FIG. 1, but is shown in the perspective view of FIG. 2. Casing half shell 122 (and 120) for a turbine system, e.g., HP-IP ST system 100, may be provided in any now known or later developed fashion, e.g., via casting and related finishing processes.

A variety of thrust bearings and journal bearings 126 may support rotor 124. Rotor 124 has an axis A. Each turbine 104, 106 includes a plurality of axially spaced rotor wheels 128 to which a plurality of rotating blades 130 are mechanically coupled. More specifically, blades 130 are arranged in rows that extend circumferentially around each rotor wheel 128. A plurality of stationary vanes (not shown for clarity) extend circumferentially around rotor 124, and the vanes are axially positioned between adjacent rows of blades 130. The stationary vanes cooperate with blades 130 to form a stage and to define a portion of a steam flow path through each turbine 104, 106. HP steam turbine 106 may have smaller blades than IP steam turbine 104. It is recognized that where HP and IP systems are separate, separate casings 110 may be used.

Embodiments of the disclosure will be described and illustrated mainly relative to an IP steam turbine 104 section of HP-IP ST system 102. It is emphasized that the teachings of the disclosure equally applicable to HP steam turbine 106 section of HP-IP ST system 102, and to upper or lower casing half shell portions thereof.

Figure 2:
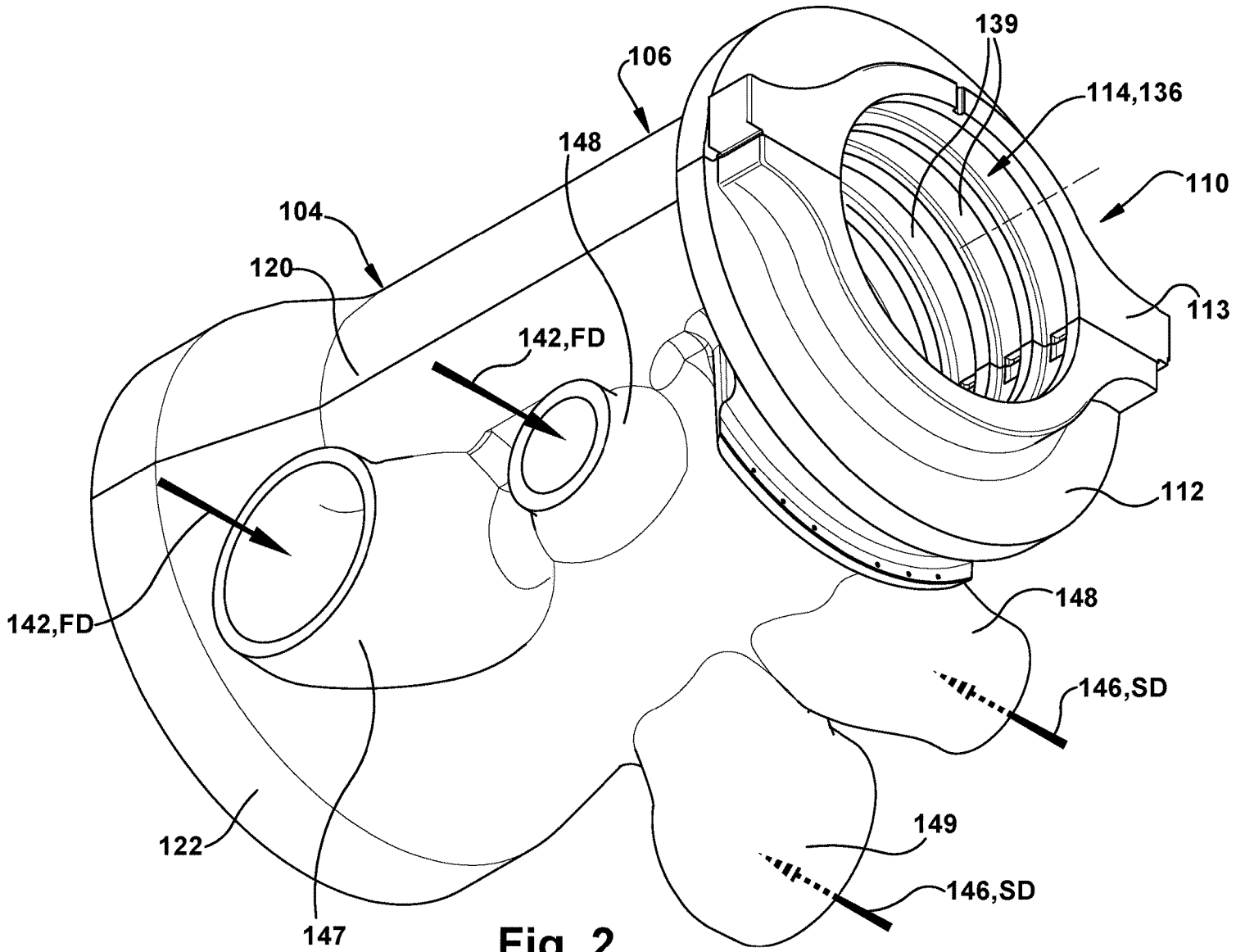
FIG. 2 shows a perspective view of an illustrative casing for the HP-IP ST system of FIG. 1.
Figure 3A:
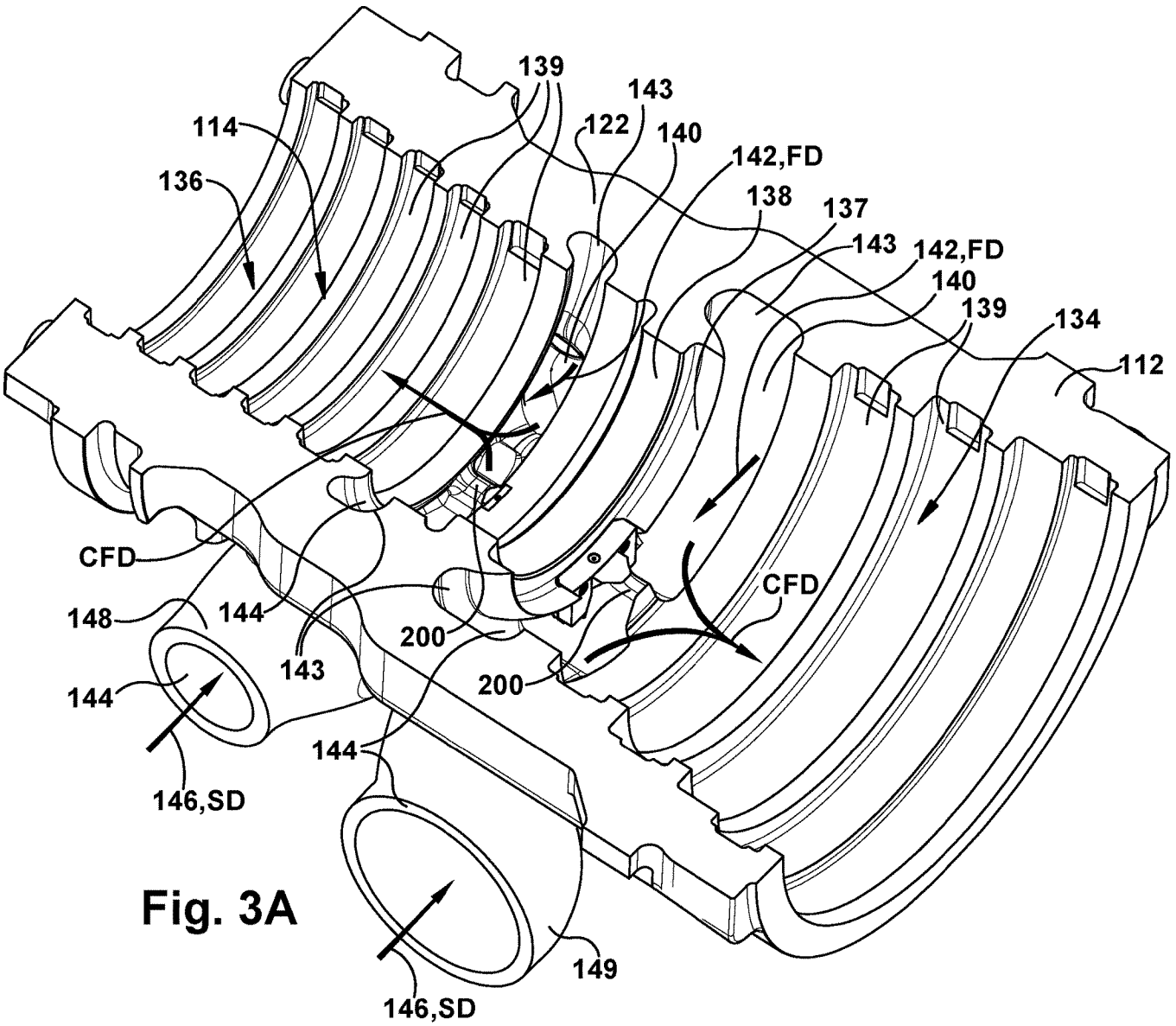
FIG. 3A shows a perspective view of an illustrative lower casing half-shell according to embodiments of the disclosure.
Figure 3B:
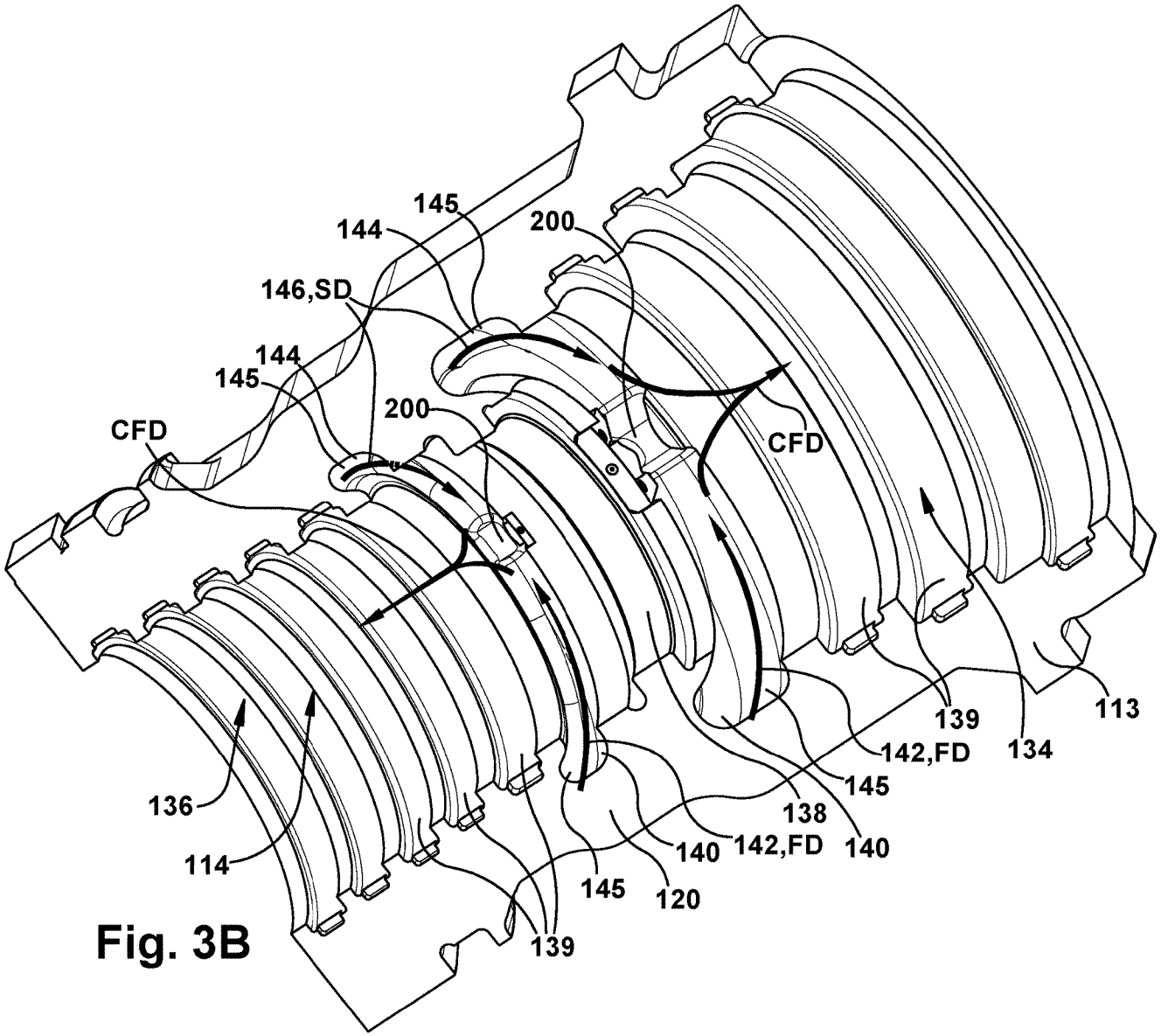
FIG. 3B shows a perspective view of an illustrative upper casing half-shell according to embodiments of the disclosure.

FIG. 2 shows a bottom perspective view of casing 110; FIG. 3A shows a top, perspective view of lower casing half shell 122 (with upper casing half shell 120 (FIGS. 1-2) removed); and FIG. 3B shows a top, perspective view of upper casing half shell 120 (flipped over with lower casing half shell 122 (FIGS. 1-2) removed). FIGS. 3A-B show a portion of open interior 114 including a space 134 for IP steam turbine 104 (FIG. 1) and a space 136 for HP steam turbine 106 (FIGS. 1-2). Spaces 134, 136 are separated by a packing head (not shown) mounted to a packing head main fit 138. A casing flow guide 137 may extend axially from packing head main fit 138. Spaces 134, 136 may include any form of diaphragm mounting elements 139 for receiving diaphragms (not shown) that extend about outer ends of rotating blades 130 (FIG. 1). Each casing half shell 120, 122 includes similar, mating diaphragm mounting elements 139.

With reference to FIGS. 2, 3A and 3B, relative to, for example, space 134 for IP steam turbine 104 (FIGS. 1-2), each casing half shell 122, 120 includes a first working fluid flow path 140 in body 112, 113 for directing a first working fluid flow 142, e.g., steam, in open interior 114 in a first direction FD, and a second working fluid flow path 144 in body 112, 113 for directing a second working fluid flow 146, e.g., steam, in open interior 114 in a second direction SD. Relative to lower casing half shell 122, first working fluid flow path 140 may be created, in part, by a first inlet 147 (FIG. 2) in body 112 for delivering first working fluid flow 142, e.g., steam, into open interior 114 in first direction FD, and second working fluid flow path 144 may be created, in part, by a second inlet 149 (FIGS. 2 and 3A) in body 112 for delivering second working fluid flow 146, e.g., steam, into open interior 114 in second direction SD. First working fluid flow path 140 and second working fluid flow path 146 in lower casing half shell 122 may also be created, in part, by a circumferentially-extending channel 143 that runs parallel to diaphragm mounting elements 139 and is in fluid communication with inlets 147, 149 (FIG. 3A). Relative to upper casing half shell 120 (FIG. 3B), first working fluid flow path 140 and second working fluid flow path 144 may be created by a circumferentially-extending channel 145 running parallel to diaphragm mounting elements 139 and in fluid communication with circumferentially extending channel 143 in lower casing half shell 122, i.e., body 112. Flow paths 140, 144 direct first working fluid flow 142 in first direction FD, and second working fluid flow 146 in second direction SD. As observed, second direction SD is tangentially opposed to first direction FD regardless of casing 120, 122 and regardless of whether at a lowermost point of lower casing half shell 122 or an uppermost point of upper casing half shell 120. In any event, working fluid flows 142, 146 travel in opposite directions in casing 110. It will be appreciated that each inlet 147, 149 (FIGS. 2 and 3A) in lower casing half shell 122 (FIG. 3A) may include any now known or later developed close-coupled valve (not shown) on an outer end thereof to control working fluid flows 142, 146 for lower casing half shell 122. It will be appreciated that working fluid flows 142, 146 have a similar flow arrangement in HP steam turbine 106.

Referring to FIGS. 1-3B, in operation, working fluid flows 142, 146, i.e., steam, initially follow first and second working fluid flow paths 140, 144 of HP steam turbine 106 and are channeled into a collective steam path (see CFD) of HP steam turbine 106, i.e., stationary vanes and rotating blades thereof. Working fluid flows 142, 146 may be sourced from any now known or later developed steam source, e.g., a heat recovery steam generator (HRSG), a boiler, etc., and delivered to inlet(s) 148 of HP steam turbine 106. As working fluid flows 142, 146 are directed by the stationary vanes and impact rotating blades 130 in HP steam turbine 106, they impart a force on the blades, causing rotor 124 to rotate. Subsequently, working fluid flows 142, 146 exit HP steam turbine 106 at an exit 150 and are redirected to one or more inlets 147, 149 for IP steam turbine 104. As understood in the art, the working fluid for IP steam turbine 104 may be reheated and/or combined with other working fluid flows prior to introduction into IP steam turbine 104. As working fluid flows into IP steam turbine 104, it is directed by the stationary vanes and impacts rotating blades 130 in IP steam turbine 104, causing rotor 124 to rotate. The working fluid flow may exit IP steam turbine 104 at an exit 152. Each turbine 104, 106 may include any number of stages of vanes and blades. At least one end of rotor 124 may be attached to a load or machinery (not shown) such as, but not limited to, a generator, and/or another turbine.

Figure 4:
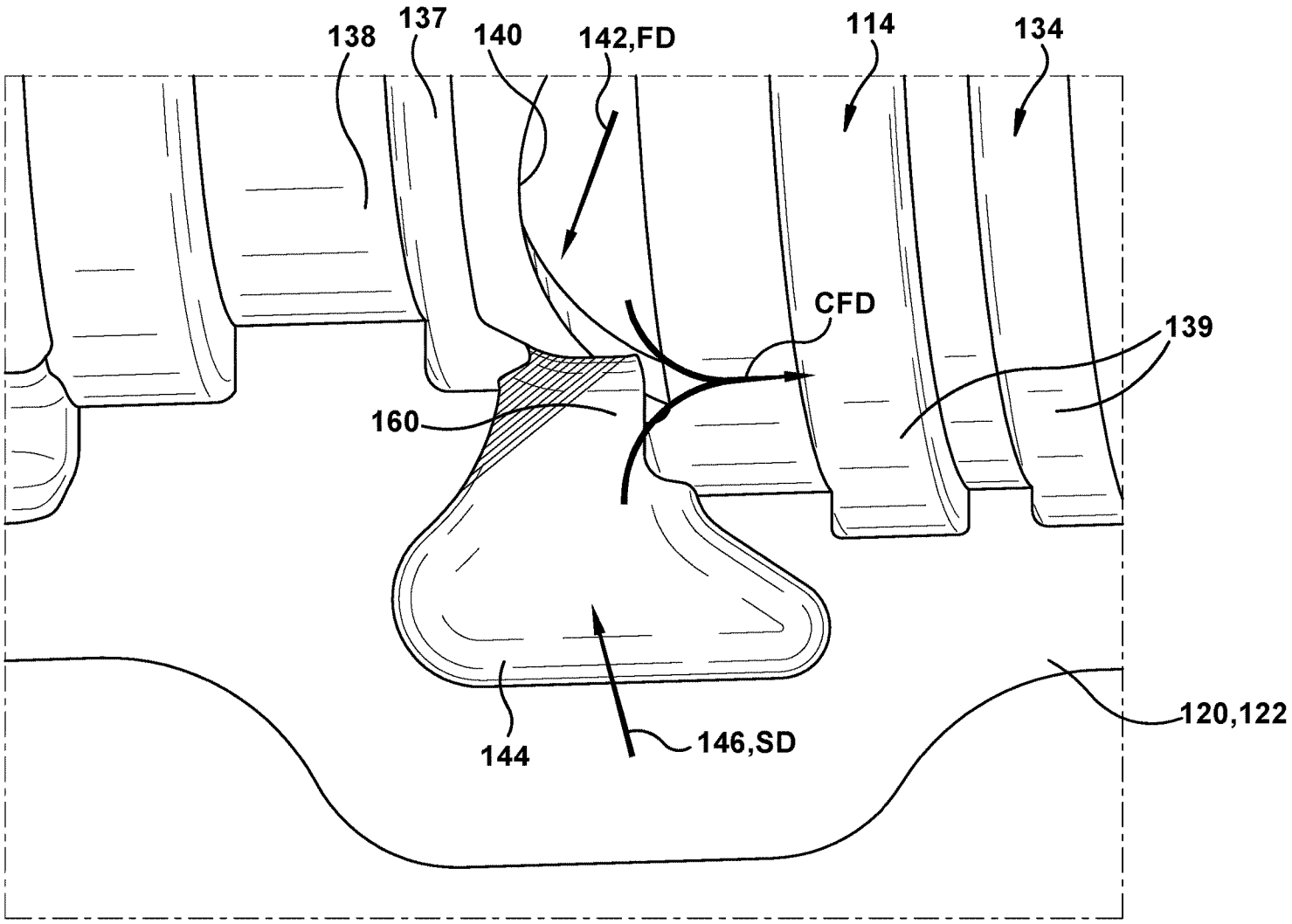
Fig. 4 (Prior Art)
FIG. 4 shows a cross-sectional view of a conventional working fluid dam.

Referring to FIGS. 3A-B and 4, as working fluid flows 142, 146 travel in open interior 114 of casing 110 in opposite tangential directions, the working fluid must be directed axially into the relevant steam turbine, i.e., HP steam turbine 106 or IP steam turbine 104 (FIG. 1)—see arrows denoting combined flow direction (CFD) in each turbine. FIG. 4 shows an enlarged, cross-sectional and perspective view of a conventional casing half shell 120, 122 where working fluid flows 142, 146 meet in casing 110—typically at an uppermost point of upper casing half shell 120 or a lowermost point of lower casing half shell 122. As illustrated in FIG. 4, conventional casing half shells include a working fluid (steam) dam 160 where working fluid flows 142, 146 meet. Dam 160 assists in re-directing working fluid flows 142, 146 with curvature of inlets 147, 149 (for lower casing half shell 122), and casing flow guide 137, axially into the relevant steam turbine 104, 106 (FIG. 1) and prevents flow oscillations. More particularly, working fluid flows 142, 146 impact dam 160 and are re-directed into steam turbine 104, 106 (FIG. 1) to the right as shown in the FIG. 4 example—see arrow CFD. Dam 160 is typically cast with casing half shell 120 or 122. Dam 160, however, creates a high local stress (see shaded area) that can require additional maintenance, and thus can reduce the availability of the system.

Figure 5:
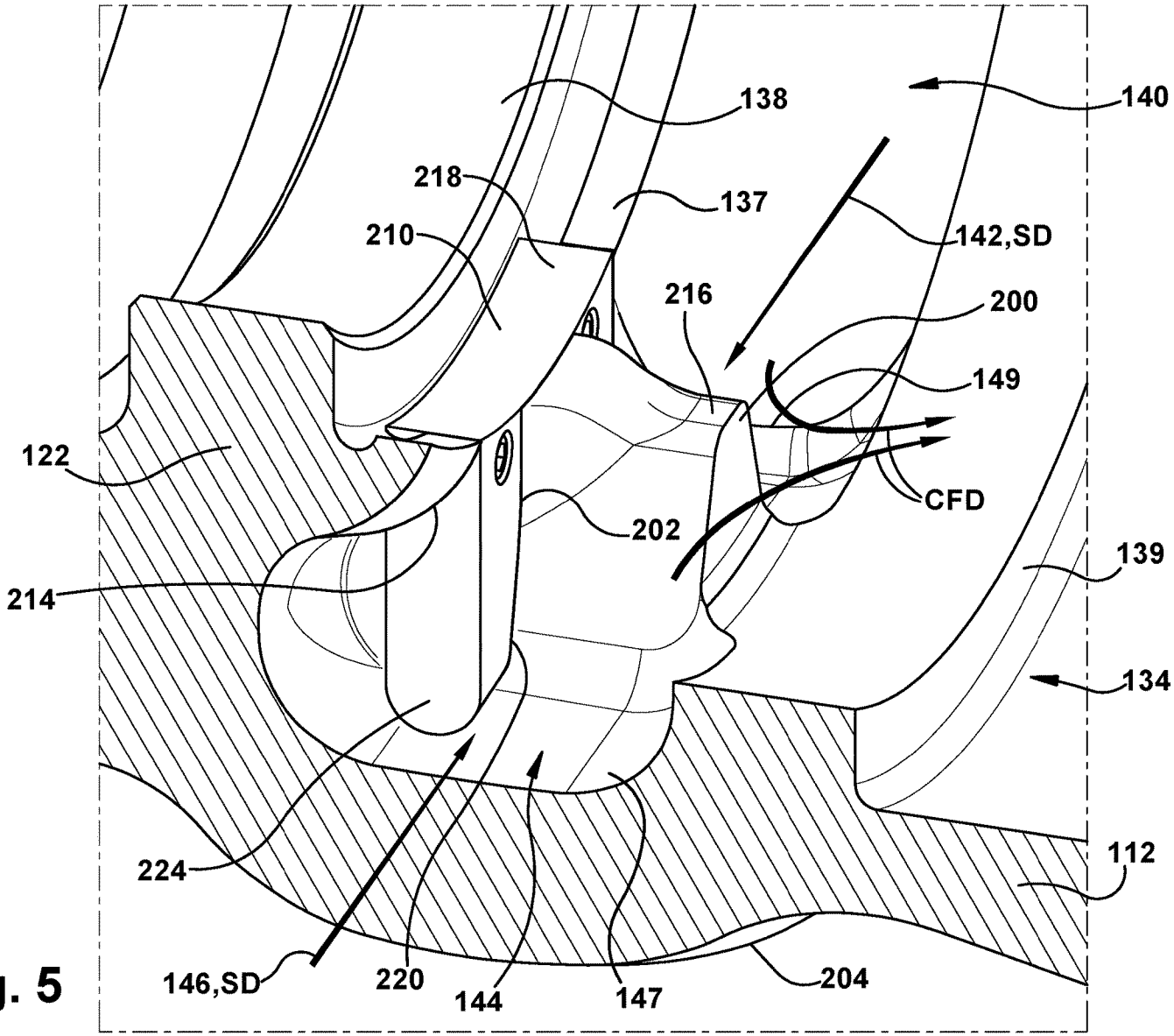
FIG. 5 shows a cross-sectional perspective view of a working fluid dam with a stress-mitigating slot and an optional fill member therein, according to embodiments of the disclosure.
Figure 6:
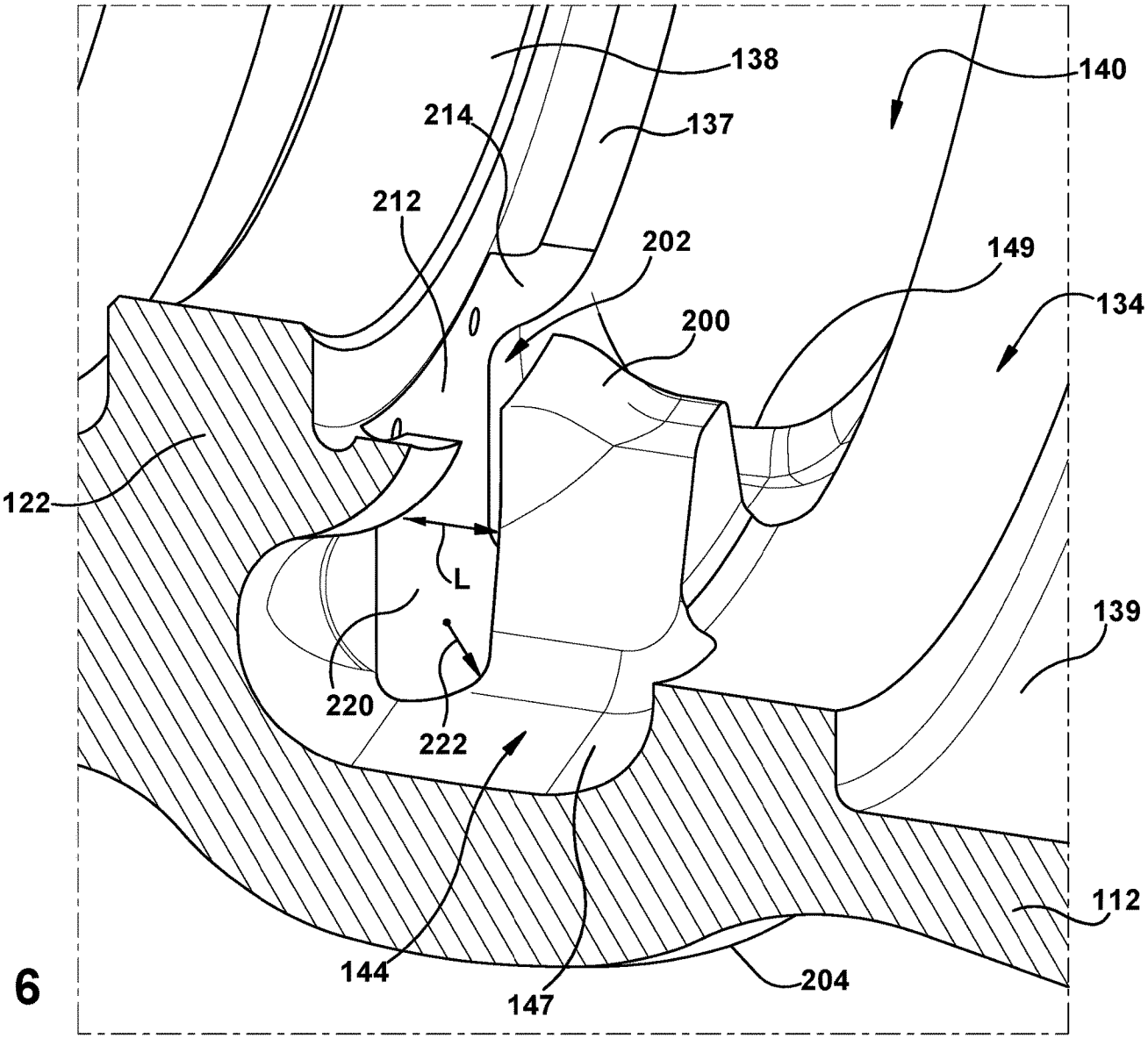
FIG. 6 shows a cross-sectional perspective view of a working fluid dam including a stress-mitigating slot therein, according to embodiments of the disclosure.
Figure 7:
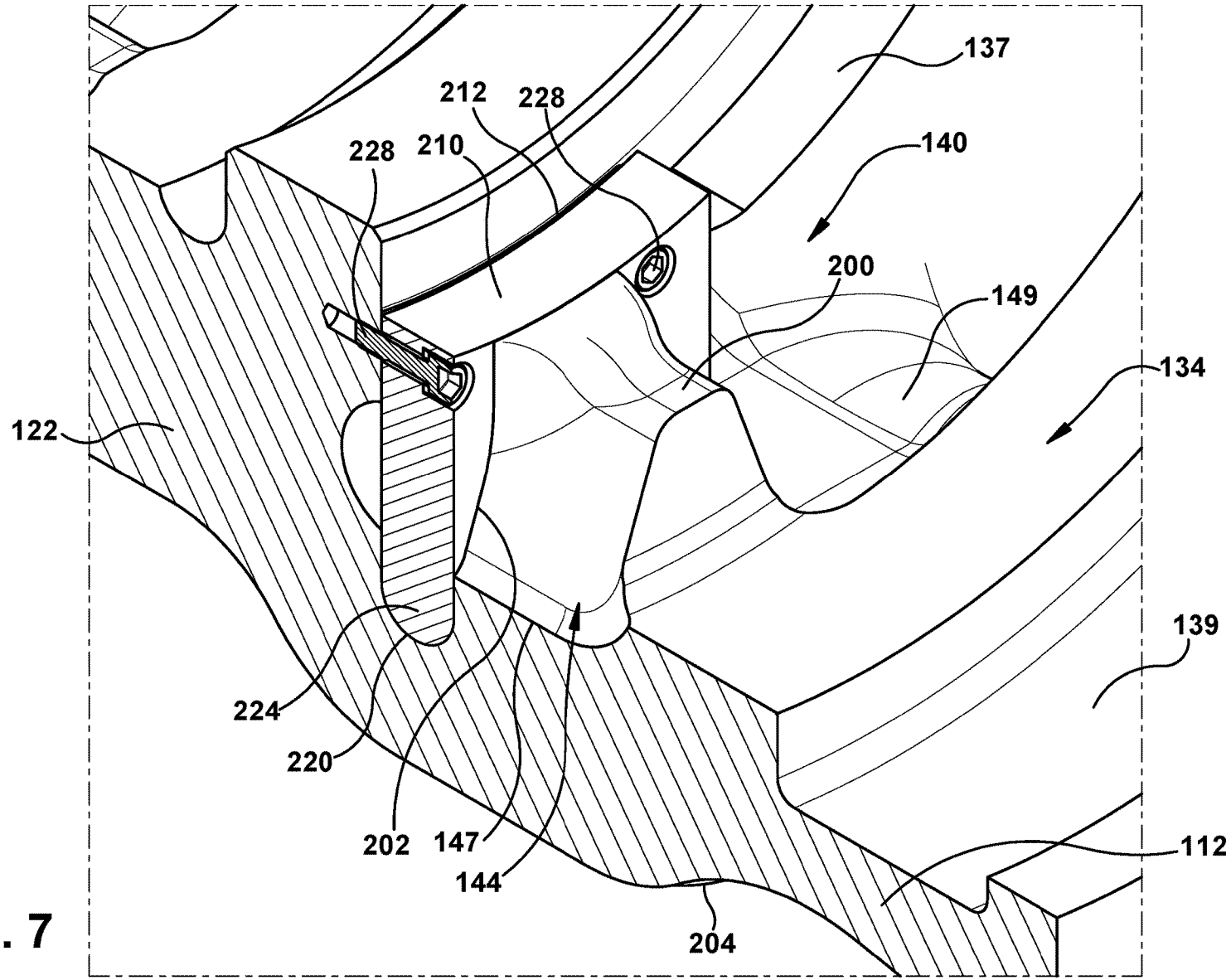
FIG. 7 shows an enlarged cross-sectional perspective view of the working fluid dam and optional fill member of FIG. 5, according to embodiments of the disclosure.

FIGS. 5-12 show various embodiments of a stress reducing arrangement for a working fluid dam in a turbine system in accordance with embodiments of the disclosure. Generally, as shown in FIGS. 5-7, embodiments of the disclosure provide a working fluid dam 200 that extends radially and axially in body 112 between first working fluid flow path 140 and second working fluid flow path 146. (Note, in FIGS. 5-7, working fluid flow paths 140, 146 are shown at inlets 147, 149 of lower casing half shell 122. Similar flow paths exist for upper casing half shell 120). Working fluid dam 200 extends radially and axially in body 112, 113 at a location where tangentially opposing working fluid flow paths 140, 146 meet, typically, at a lowermost point of lower casing half shell 120 or an uppermost point of upper casing half shell 120. In contrast to conventional working fluid dams, working fluid dam 200 includes a stress-mitigating slot 202 extending radially therein. That is, stress-mitigating slot 202 is defined radially within working fluid dam 200. Stress-mitigating slot 202 causes any high local stress to be located radially outward in casing half shell 122, and more particularly, into a thicker metal 204 of casing half shell 120 or 122. Thicker metal 204 is more capable of absorbing any high stress experienced during operation. Hence, stress-mitigating slot 202 reduces stress in a high stress-prone area that may form in the dam and forces stresses radially outward in the casing half shell to either maintain current stress or relieve the high stress from the working fluid dam. As illustrated, body 112 (and 113) includes packing head main fit 138 with casing flow guide 137 extending axially therefrom upstream of working fluid dam 200 and diaphragm mounting element(s) 139 downstream of working fluid dam 200, i.e., relative to steam turbine 104, 106 (FIG. 1). It is understood the diaphragm mounting elements 139 are configured to receive diaphragms (not shown) that aerodynamically interact with rotating blades 130 (FIG. 1) to receive the kinetic energy of working fluid flows 142, 146. In order to continue to provide the full functionality of working fluid dam 200, and as will be further described herein, casing half shell 122 may further optionally include a fill member 210 mounted in stress-mitigating slot 202.

Figure 8:
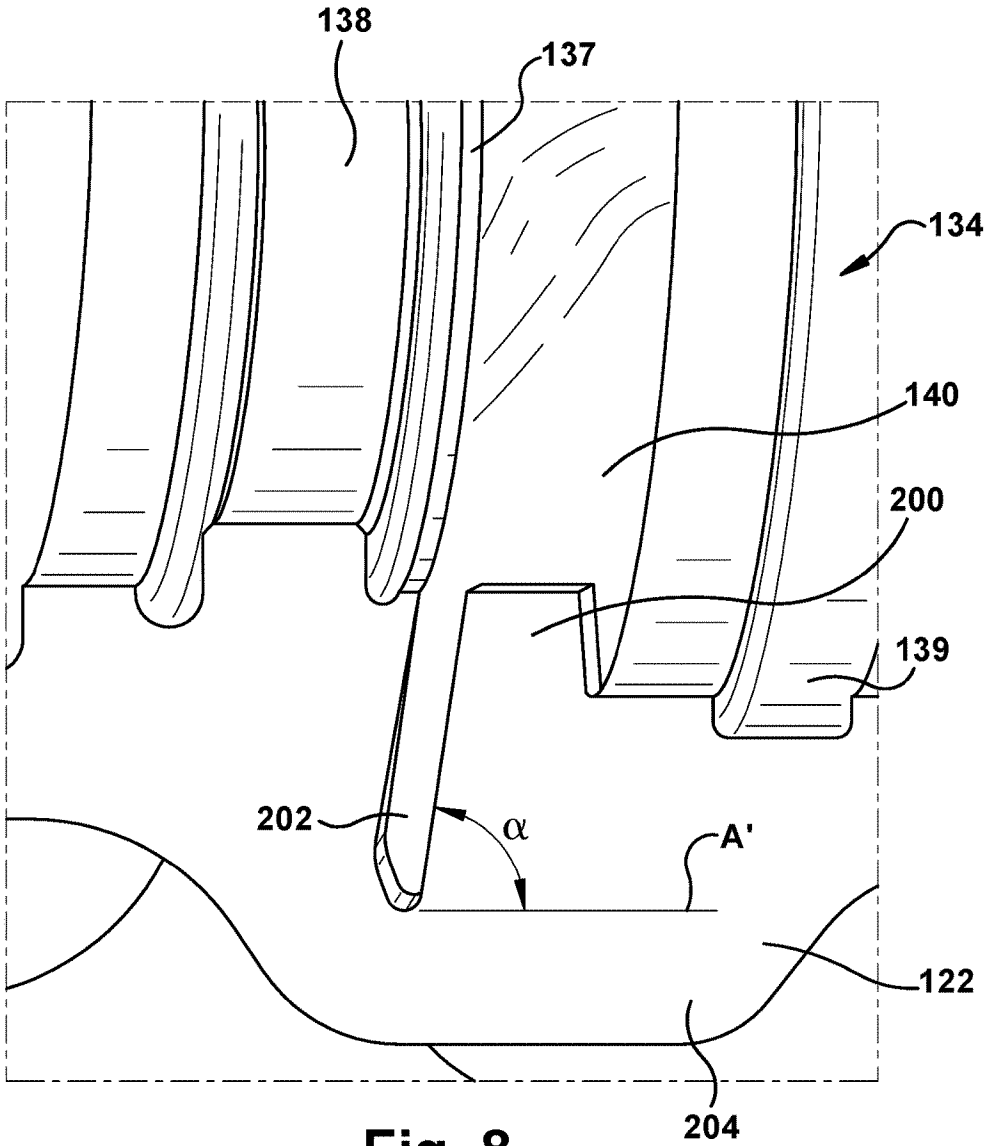
FIG. 8 shows a cross-sectional perspective view of a working fluid dam including an axially angled stress-mitigating slot therein, according to embodiments of the disclosure.

Stress-mitigating slot 202 may be formed to extend radially in working fluid dam 200. Stress-mitigating slot 202 can be formed using any now known or later developed technique such as but not limited to: milling, electric discharge machining, laser cutting, water jetting, grinding, etc. As used herein, "extend radially" as it applies to stress-mitigating slot 202 indicates the slot extends generally radially but that some axial angling is allowable. For example, as shown in FIG. 8, stress-mitigating slot 202 has an angle $\alpha$ relative to an axis A' (parallel to rotor axis A in FIG. 1). Angle $\alpha$ may be, for example, between approximately 0.1° and 10°. Stress-mitigating slot 202 may be positioned in any axial location in working fluid dam 200 desired to, e.g., relieve a high local stress. For example, as shown in FIGS. 5-7 and in particular in FIG. 6, stress-mitigating slot 202 may extend adjacent an axially facing surface 212 of packing head main fit 138, leaving a remaining portion of working fluid dam 200 as is. Here, a portion of casing 122 may be removed, e.g., by milling, to form an opening 214 (FIGS. 5 and 6) therein, i.e., as part of stress-mitigating slot 202 therein. As part of the removal, a part of casing flow guide 137 may be removed. In addition, stress-mitigating slot 202 may have any shape, axial width and/or radial depth desired to reduce and/or relieve stress. In terms of shape, as shown best in FIG. 6, although not necessary in all cases, stress-mitigating slot 202 may have a radial outer end 220 including a curved shape 222, i.e., a stress-mitigating contour or radius. The radius may include, for example, a single radius or a compound radius. In addition, while shown as a generally linear slot, the slot may curve. Stress-mitigating slot 202 may extend to any radial depth. In one example, shown in FIGS. 5 and 6, stress-mitigating slot 202 extends to be coplanar or nearly coplanar with a surface of inlet(s) 147, 149 and/or a bottom of working fluid dam 200. Alternatively, as shown in one example in FIG. 7, stress-mitigating slot 202 may extend deeper into body 112 (or 113), e.g., deeper than a surface of flow paths 140, 144 and/or a bottom of working fluid dam 200. Stress-mitigating slot 202 may extend to any axial length L and use any required axial extent of working fluid dam 200 necessary to address the expected stress. The shape (e.g., radius), axial length and radial depth used can each vary depending on a number of factors such as but not limited to: a width of dam 200, the material used, operational parameter such as temperature, expected thermal cycling, desired stress to be removed, the location to which the stress is to be directed, etc.

Fill member 210 may be optionally fixedly coupled in stress-mitigating slot 202 in any now known or later developed fashion. Fill member 210 may be used, for example, to provide full functioning of working fluid dam 200, despite the presence of stress-mitigating slot 202. Fill member 210 may not be necessary in all cases. As shown in FIGS. 5 and 7, in this embodiment, fill member 210 may be fixedly coupled to packing head main fit 138. In this example, fill member 210 is at least partially positioned in opening 214 (FIGS. 5 and 6) in casing 122, e.g., in casing flow guide 137. Fill member 210 may be fixedly coupled, for example, by welding (FIG. 5), or using fasteners 228 (FIG. 7), e.g., screws, bolts, etc. In the FIGS. 5-7 embodiment, fixedly coupling fill member 210 includes positioning the fill member in the stress-mitigating slot 202 and opening 214, e.g., sliding it in, and coupling it to working fluid dam 200, packing head main fit 138, casing 122 and/or other structure.

Fill member 210 may have any shape and size desired to fill stress-mitigating slot 202, and be fixedly coupled in place. In FIGS. 5 and 7, fill member 210 includes a planar plate. In addition, although not necessary in all cases, where stress-mitigating slot 202 includes radial outer end 220 including curved shape 222 (FIG. 6), as shown in FIGS. 5 and 7, fill member 210 may have a complementary curved shape 224. As shown in one example in FIG. 9, fill member 210 may also have a radially inner end 216 that is shaped to match a radially inner end 218 of working fluid dam 200. Alternatively, fill member 210 may have a radially inner end 218 that does not match a radially inner end 218 of working fluid dam 200 (see e.g., FIG. 5). Where stress-mitigating slot 202 is curved, fill member 210 may be similarly curved.

Figure 9:
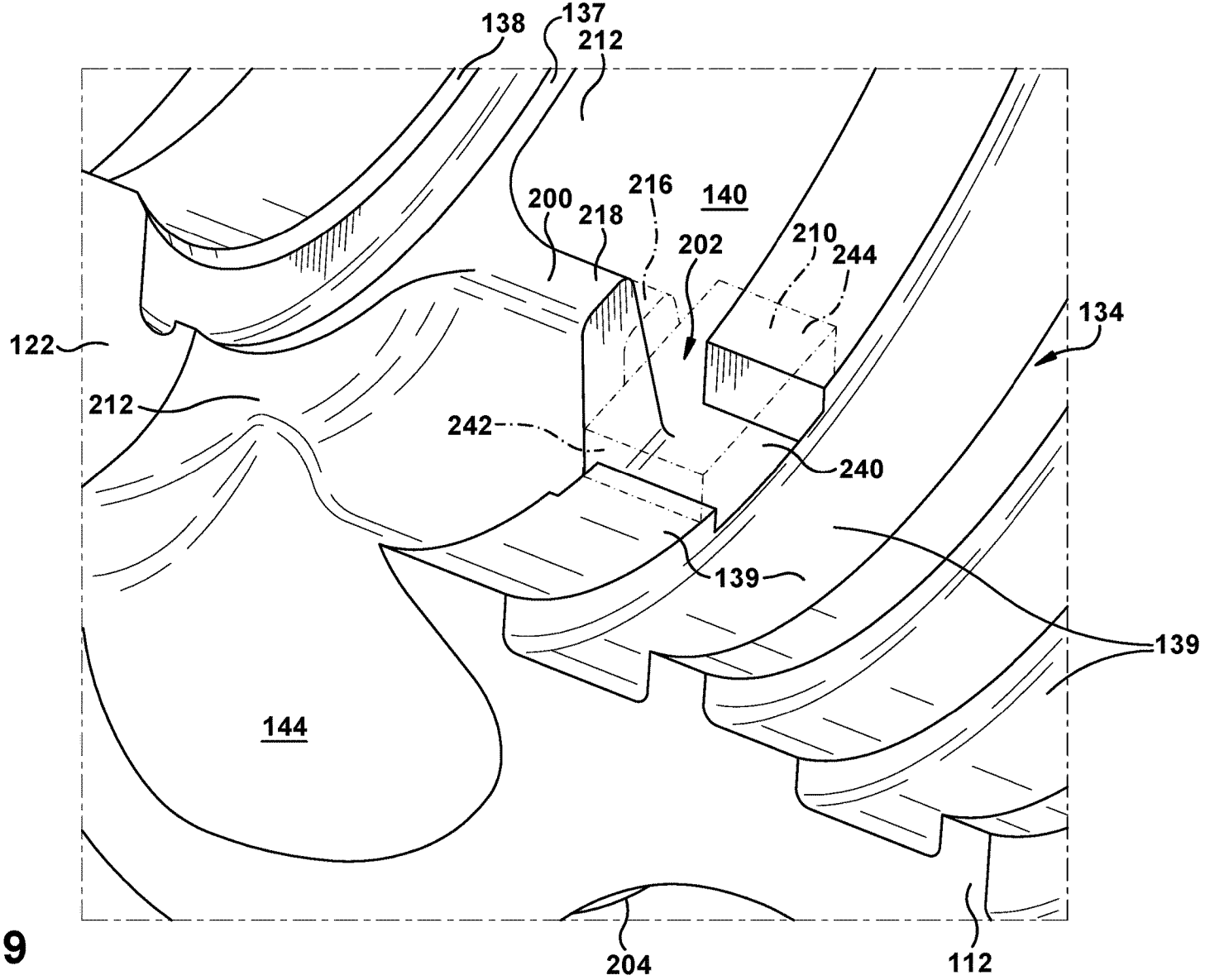
FIG. 9 shows a cross-sectional perspective view of a working fluid dam including a stress-mitigating slot therein, according to embodiments of the disclosure.
Figure 10:
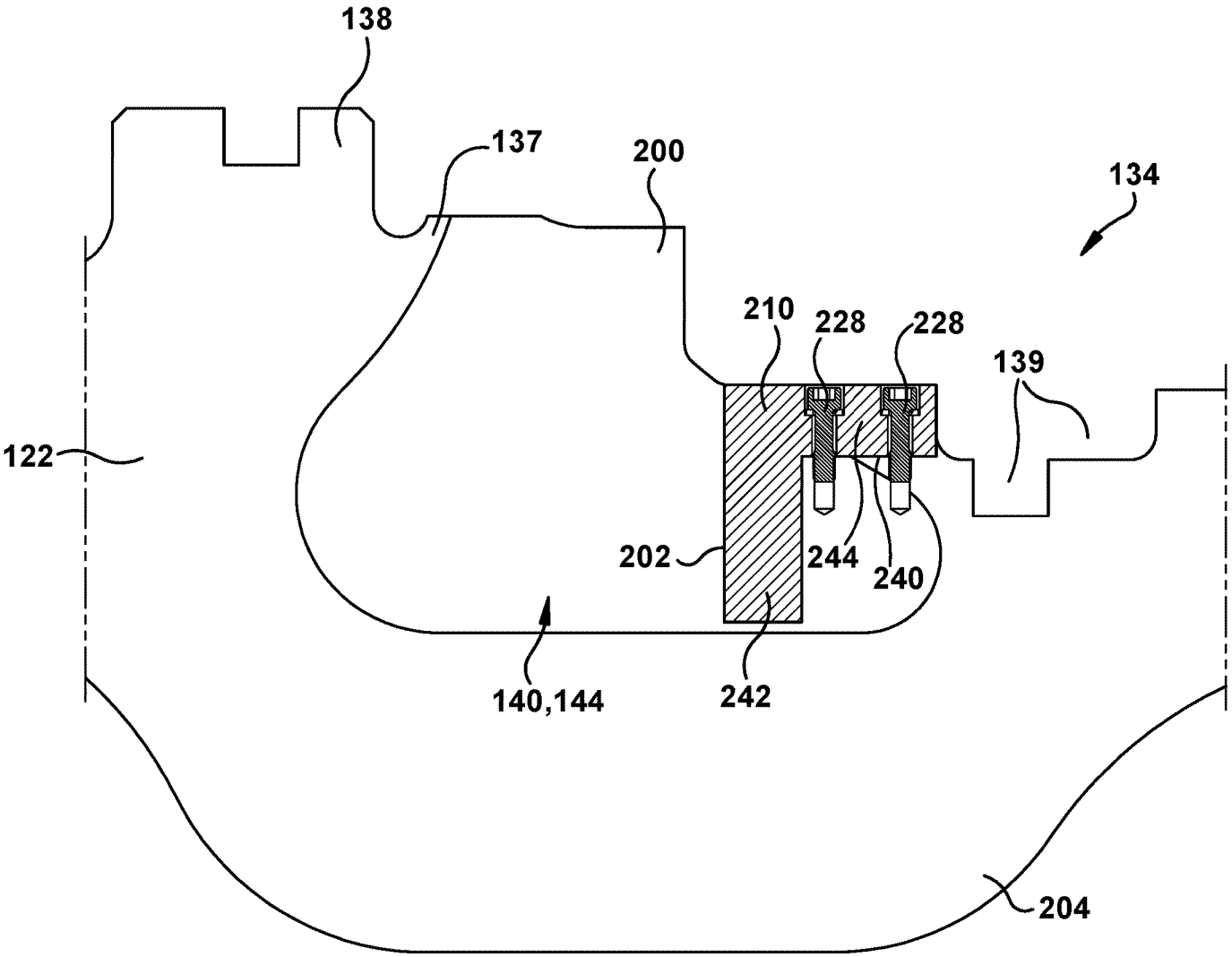
FIG. 10 shows a schematic cross-sectional view of a working fluid dam including a stress-mitigating slot therein, according to other embodiments of the disclosure.

FIGS. 9-12 show additional alternative embodiments of fill member 210 and stress-mitigating slot 202 arrangements. FIG. 9 shows a perspective view of working fluid dam 200 and fill member 210 according to certain embodiments, and FIG. 10 shows a schematic cross-sectional view of a similar arrangement to that of FIG. 9. In FIGS. 9 and 10, diaphragm mounting element 139 includes an opening 240 therein, e.g., a slot, and fill member 210 is at least partially positioned in opening 240. Here, opening 240 may be formed into diaphragm mounting element 139, e.g., using any technique listed herein for forming slot 202, and fill member 210 is positioned in stress-mitigating slot 202 and opening 240, and fixedly coupled therein. In certain embodiments such as those shown in FIGS. 9 and 10, fill member 210 has two angled portions 242, 244 (FIG. 10). In one example, fill member 210 has an L-shape with a slot portion 242 in stress-mitigating slot 202 and an axial portion 244 extending into opening 240. Fill member 210 may be fixedly coupled in the slot in any manner, e.g., by fasteners 228 (FIG. 10) or welding, to working fluid dam 200 and/or diaphragm mounting element 139. While portions 242, 244 are shown as perpendicular to one another that is not necessary in all instances, i.e., they can be set at other angles.

Figure 11:
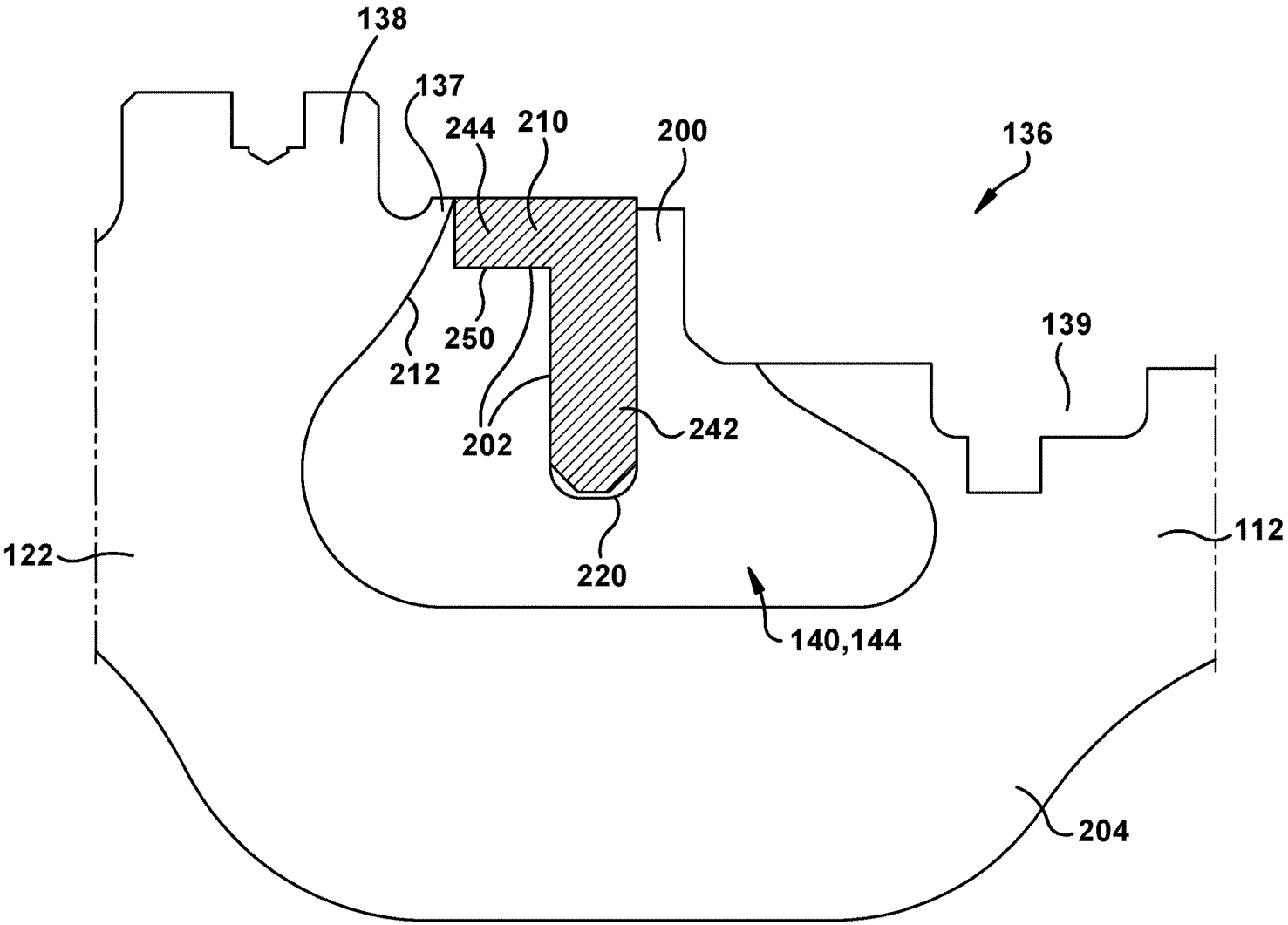
FIG. 11 shows a schematic cross-sectional view of a working fluid dam including a stress-mitigating slot therein, according to yet other embodiments of the disclosure.

As shown in the schematic cross-sectional view of FIG. 11, stress-mitigating slot 202 may extend radially in working fluid dam 200, but may also include an additional axially extending portion 250 in working fluid dam 200 alone (not in packing head main fit 138 or diaphragm mount element 139). Here, fill member 210 has an L-shape with slot portion 242 in stress-mitigating slot 202 and axial portion 244 extending into axially extending portion 250 of slot 202. Here, fill member 210 is just fixedly coupled to working fluid dam 200. Fill member 210 may be fixedly coupled in the slot in any manner, e.g., by fasteners 228 (FIG. 10) or welding, to working fluid dam 200. While shown with axial portion 244 of fill member 210 extending in a direction towards IP steam turbine 104 (FIG. 1) in FIG. 11, it is recognized that axial portion 244 may extend towards space 136 for HP steam turbine 106 (FIG. 1). Further, while the L-shapes of fill member 210 in the examples shown have slot portion 242 and axial portion 244 at perpendicular angles, portions 242, 244 may be at a non-perpendicular angle, e.g., for situations where slot is axially angled as in FIG. 8.

Figure 12:
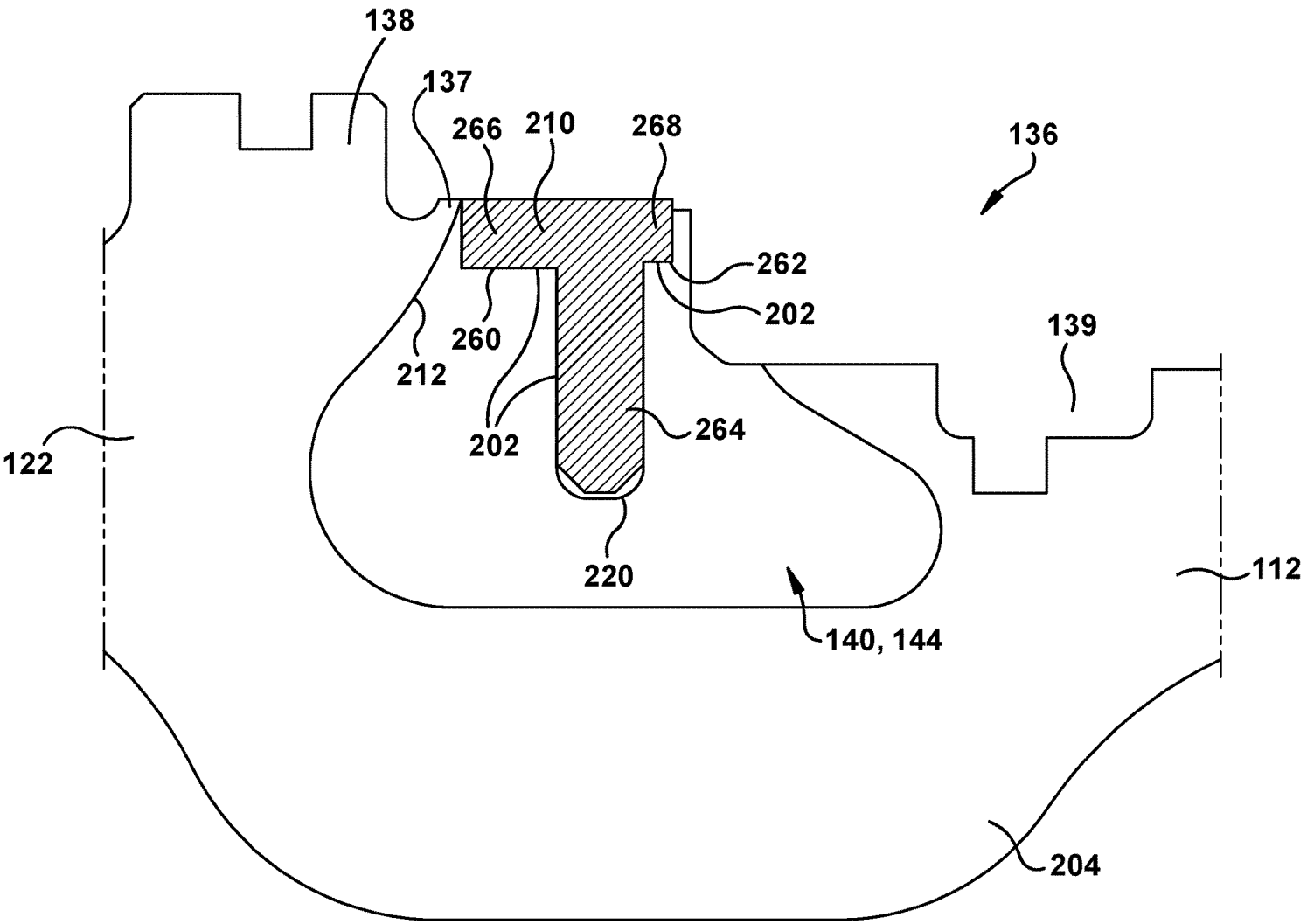
FIG. 12 shows a schematic cross-sectional view of a working fluid dam including a stress-mitigating slot therein, according to additional embodiments of the disclosure.

As shown in the schematic cross-sectional view of FIG. 12, in another embodiment, stress-mitigating slot 202 may extend radially in working fluid dam 200, but may include an additional two axially extending portions 260, 262 in working fluid dam 200 alone (not in packing head main fit 138 or diaphragm mount element 139). Here, fill member 210 has a T-shape with a slot portion 264 in stress-mitigating slot 202, a first axial portion 266 extending into a first axially extending portion 260 of slot 202, and a second axial portion 268 extending into a second axially extending portion 262 of slot 202. Fill member 210 may be just fixedly coupled to working fluid dam 200. Fill member 210 may be fixedly coupled in the slot in any manner, e.g., by fasteners or welding, to working fluid dam 200. Here, fill member 210 may have a T-shape, which can be symmetrical or non-symmetrical. Although not shown, in other embodiments, fill member 210 may also have axial portions 266 and/or 268 extend into packing head main fit 138 and/or diaphragm mounting element 139, similar to FIGS. 5 and 10.

While shown fixedly coupled to particular structure in the examples shown, it is emphasized that fill member 210 may be fixedly coupled to any of working fluid dam 200, packing head main fit 138, diaphragm mounting element 139 and/or other structure, depending on its shape and size.

While embodiments of the disclosure have been mainly illustrated and described relative to use in IP steam turbine 104 (FIG. 1) and/or lower casing half shell 122 thereof, it is emphasized that the teachings are applicable to HP steam turbine 106 (FIG. 1) and the lower and/or upper casing half shells thereof.

Stress-mitigating slot 202 provides a mechanism to implement a low cost working fluid dam 200 where necessary to reduce stress, such as in a double-shell opposed flow configuration. Fill member 210 may be employed, where desired, to retain the functioning of the working fluid dam, e.g., with little to no leakage thereacross. The manufacturing process can be carried out via conventional casing 110 formation processes, e.g., casting, with working fluid dam 200, and then removing a section of material using to create stress-mitigating slot 202 with, for example, any desired stress-mitigating contour. Fill member 210 can then be optionally fixedly coupled in the slot to block the working fluid cross-flow area. The arrangement and process enable a significant cost reduction of the opposed flow configuration versus the separate HP and IP shell configurations, and may provide similar savings in other applications. The teachings of the disclosure can be applied to any type of turbine, and in either casing half shell thereof.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise. "Approximately" as applied to a particular value of a range applies to both values, and unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A casing half shell for a turbine system, the casing half shell comprising:

a body having an open interior for enclosing parts of the turbine system;

a first working fluid flow path defined in the body for directing a first working fluid flow in the open interior in a first circumferential direction;

a second working fluid flow path defined in the body for directing a second working fluid flow in the open interior in a second circumferential direction that is opposed to the first circumferential direction; and a working fluid dam extending radially and axially in the body between the first working fluid flow path and the second working fluid flow path, the working fluid dam including a slot extending radially therein.

2. The casing half shell of claim 1, further comprising a fill member mounted in the slot.

3. The casing half shell of claim 2, wherein the body further includes a packing head main fit upstream of the working fluid dam and a diaphragm mounting element downstream of the working fluid dam.

4. The casing half shell of claim 3, wherein the slot extends adjacent an axially facing surface of the packing head main fit, and the fill member is fixedly coupled to the packing head main fit.

5. The casing half shell of claim 3, wherein the casing includes an opening therein, and wherein the fill member is at least partially positioned in the opening.

6. The casing half shell of claim 3, wherein the diaphragm mounting element includes an opening therein, and wherein the fill member is at least partially positioned in the opening.

7. The casing half shell of claim 2, wherein the fill member has a shape selected from the group comprising: a planar plate, an L-shape, and a T-shape.

8. The casing half shell of claim 2, wherein the fill member is fixedly coupled to the working fluid dam.

9. The casing half shell of claim 2, wherein the slot has a radial outer end including a curved shape, and the fill member has a complementary curved shape.

10. A steam turbine (ST) system, the ST system comprising:

at least one of a high pressure (HP) turbine and an intermediate pressure (IP) turbine;

a casing including a body having an open interior for enclosing the at least one of the HP steam turbine and the IP steam turbine;

a first working fluid flow path defined in the body for directing a first working fluid flow in the open interior in a first direction;

a second working fluid flow path defined in the body for directing a second working fluid flow in the open interior in a second direction that is opposed to the first direction; and a steam dam extending radially and axially in the body between the first working fluid flow path and the second working fluid flow path to redirect the first and second working fluid flows to the at least one of the HP steam turbine and the IP steam turbine, the steam dam including a stress-mitigating slot extending radially therein; and a fill member mounted in the stress-mitigating slot.

11. The ST system of claim 10, further comprising a packing head main fit upstream of the steam dam and a diaphragm mounting element downstream of the steam dam.

12. The ST system of claim 11, wherein the stress-mitigating slot extends adjacent an axially facing surface of the packing head main fit, and the fill member is fixedly coupled to the packing head main fit.

13. The ST system of claim 11, wherein the casing includes an opening therein, and wherein the fill member is at least partially positioned in the opening.

14. The ST system of claim 11, wherein the diaphragm mounting element includes an opening therein, and wherein the fill member is at least partially positioned in the opening.

15. The ST system of claim 10, wherein the fill member has a shape selected from the group comprising: a planar plate, an L-shape and a T-shape.

16. The ST system of claim 10, wherein the fill member is fixedly coupled to the steam dam.

17. The ST system of claim 10, wherein the stress-mitigating slot has a radial outer end including a curved shape, and the fill member has a complementary curved shape.

18. A method, comprising:

providing a casing half shell for a turbine system, the casing half shell including a body having open interior, a first working fluid flow path defined in the body for directing a first working fluid flow in the open interior in a first direction, a second working fluid flow path defined in the body for directing a second working fluid flow in the open interior in a second direction that is opposed to the first direction, and a working fluid dam extending radially and axially in the body between the first working fluid flow path and the second working fluid flow path; forming a stress-mitigating slot extending radially in the working fluid dam; and fixedly coupling a fill member in the stress-mitigating slot.

19. The method of claim 18, further comprising positioning a packing head main fit upstream of the steam dam with a casing flow guide extending therefrom and a diaphragm mounting element downstream of the steam dam, and wherein forming the stress-mitigating slot includes forming an opening into one of the casing flow guide and the diaphragm mounting element, and wherein fixedly coupling the fill member includes positioning the fill member in the stress-mitigating slot and the opening.

20. The method of claim 19, wherein fixedly coupling the fill member includes fixedly coupling the fill member to at least one of the working fluid dam, the packing head main fit and the diaphragm mounting element.

* * * * *